US006981391B2

(12) United States Patent
Suzuki

(10) Patent No.: US 6,981,391 B2
(45) Date of Patent: Jan. 3, 2006

(54) CONNECTOR FOR ACCESSORIES

(75) Inventor: Hideya Suzuki, Saitama-ken (JP)

(73) Assignee: Luxcess Company Ltd., Saitama-Ken (JP)

( * ) Notice: Subject to any disclaimer, the term of this patent is extended or adjusted under 35 U.S.C. 154(b) by 0 days.

(21) Appl. No.: 10/861,508

(22) Filed: Jun. 7, 2004

(65) Prior Publication Data

US 2004/0244419 A1 Dec. 9, 2004

(30) Foreign Application Priority Data

Jun. 6, 2003 (JP) ..... 2003-162442

(51) Int. Cl.
*A44C 5/00* (2006.01)

(52) U.S. Cl. ..... 63/3.1; 63/3; 63/900; 63/4; 63/35; 63/3.2; 24/303

(58) Field of Classification Search ..... 63/900, 63/3, 3.1, 3.2, 3.5, 4; 24/303
See application file for complete search history.

(56) References Cited

U.S. PATENT DOCUMENTS 2,615,227 A * 10/1952 Hornik ..... 24/303
2,648,884 A * 8/1953 Loofboro ..... 24/303
2,975,497 A * 3/1961 Budreck ..... 24/303
4,231,137 A * 11/1980 Fujimoto ..... 24/303
4,622,726 A * 11/1986 Nakamura ..... 24/571.1
4,901,405 A * 2/1990 Grover et al. ..... 24/303
4,982,581 A * 1/1991 Furuyama ..... 63/29.1
5,008,984 A * 4/1991 Levy ..... 24/303
5,050,276 A * 9/1991 Pemberton ..... 24/303
5,197,168 A * 3/1993 Levy ..... 24/303
5,311,647 A * 5/1994 Levy ..... 24/303
5,317,789 A * 6/1994 Levy ..... 24/303
5,349,725 A * 9/1994 Levy ..... 24/303
5,367,891 A * 11/1994 Furuyama ..... 63/29.2
5,572,887 A * 11/1996 Geswelli ..... 63/3
5,664,298 A * 9/1997 Nessar-Ivanovic ..... 24/303
5,806,346 A * 9/1998 Schlinger et al. ..... 63/40
5,920,966 A * 7/1999 Chen ..... 24/303
6,505,385 B2 * 1/2003 Grunberger ..... 24/303
6,640,398 B2 * 11/2003 Hoffman ..... 24/303

FOREIGN PATENT DOCUMENTS

JP 5-269010 10/1993
JP 3021562 11/1995

* cited by examiner

*Primary Examiner*—Robert J. Sandy
*Assistant Examiner*—David Reese
(74) *Attorney, Agent, or Firm*—Jacobson Holman PLLC

(57) ABSTRACT

A connector for accessories, etc, which is mounted on both ends of a long linear member, the connector comprising a male part and a female part, which can fit into and separate from each other, and wherein when the male part is inserted into the female part from a fitting opening, magnetic attraction causes a change in the positional relationship between the male part and the female part with the result that the male part cannot pass through the fitting opening of the female part.

3 Claims, 5 Drawing Sheets

CONNECTOR FOR ACCESSORIES

BACKGROUND OF THE INVENTION

1. Field of the Invention

The invention relates to a connector for accessories, etc, which is mounted on both ends of a long linear member such as chain-shaped, braid-shaped, or the like to be applied with a view of making the linear member annular.

2. Description of the Related Art

A conventional connector used in, for example, a necklace or the like generally comprises a ring, which is called a pull ring and a part of which can be opened and closed by a spring, and a perforated plate hooked over the ring. Utility models related to a similar construction include a clasp described in Japanese Utility Model No. 3021562. However, this type of clasp involves in many cases a disadvantage that accuracy is hard to obtain for constructional reasons and strength is hard to be increased, whereby the clasp is in many cases so out of order that it works badly and makes the spring inoperative. In addition, since there is a need for conducting, behind the neck, operations of opening the ring by hooking the small projection with nails, the handling is not easy.

In contrast, JP-A-5-269010 discloses an invention relating to an electronic clasp, in which a male part of a connector with a magnet built therein is inserted into a female part of the connector. With the above invention, magnetic forces and a stopper of the connector are used to connect the male part of the connector with the female part of the connector. However, magnetic forces serve only to magnetically attract the male part of the connector and the female part of the connector to each other and these parts are separated upon pulling, so that effective connection cannot be achieved unless a projection called a stopper is caused to engage with a groove.

SUMMARY OF THE INVENTION

The invention has been made in view of the above points. Its objective is to enable an easy and sure connection even without conventionally conducting, behind the neck, operations of moving a small projection with nails, or engaging a projection of a stopper with a groove. In addition, it is another object of the invention to provide a connector for accessories, in which a male part is automatically fitted into a female part by magnetic forces to achieve a state of effective connection.

In order to perform the above objects, the invention provides a connector for accessories, etc, which is mounted on both ends of a long linear member such as chain-shaped, braid-shaped, or the like to be applied with a view of making the linear member annular, the connector comprising a male part and a female part, which can be fitted into and separated from each other, and wherein when the male part is inserted into the female part from a fitting opening of the female part, magnetic attraction causes a change in the positional relationship between the male part and the female part with the result that the male part cannot pass through the fitting opening of the female part.

The invention relates to a connector for accessories, etc, and the linear member corresponds to a braid-shaped one extending through accessories such as necklace or ornaments that constitute accessories. Accordingly, when mounted on both ends of the linear member, the connector according to the invention is used to let the linear member form an endless chain.

The connector comprises a male part and a female part, which can be fitted into and separated from each other. When the male part is inserted into the female part from a fitting opening thereof, the male part and the female part are put in a state of attracting each other due to magnetic attraction and the male part moves, relative to the female part, from a position, in which fitting of the male part from the fitting opening is enabled, to a position that is determined by the magnetic attraction. That is, the male part is moved (traveled or turned) from a position, in which it is fitted into the fitting opening of the female part, to a position, in which the male part cannot pass through the fitting opening of the female part. Movements (traveling or turning) of the male part are automatically caused by the magnetic attracting action, and accordingly what is demanded from a user is only to fit the male part into the fitting opening of the female part. In addition, in case of separation of the connectors put in the fitting state, it suffices to move the male part and look for a position, in which the male part can get out of the fitting opening of the female part, so that operations are quite easy even by means of grouping.

Several methods can be applied in order to cause magnetic attraction between the male part and the female part. The methods are classified into a method of incorporating magnets into the male part and the female part, and a method of magnetizing target portions of the male part and the female part to a desired magnetism, the both methods being applicable.

According to an additional embodiment, the male part preferably comprises a head that passes through the fitting opening of the female part, and a neck being positioned in the fitting opening of the female part during fitting to enable relative turning of the male part. The head is configured to be able to pass through the fitting opening and to assume that positional relationship, in which it cannot get out of the fitting opening because the positional relationship is changed due to the magnetic attracting action after passage through the fitting opening of the female part by the male part.

In addition, the female part is required to comprise a cavity therein in communication with the fitting opening, which permits the male part to pass therethrough, and allows the rotation of the head of the male part. Since the cavity suffices to allow turning of the male part, there are no restrictions on its configuration. In the light of the structure, in which the male part is fitted into the female part, it is preferable to arrange magnets in such a manner that the magnetic attracting action is generated after the fitting, and it does not matter whether the male part and the female part contact directly with each other after the fitting.

DESCRIPTION OF THE PREFERRED EMBODIMENTS

Figure 1:
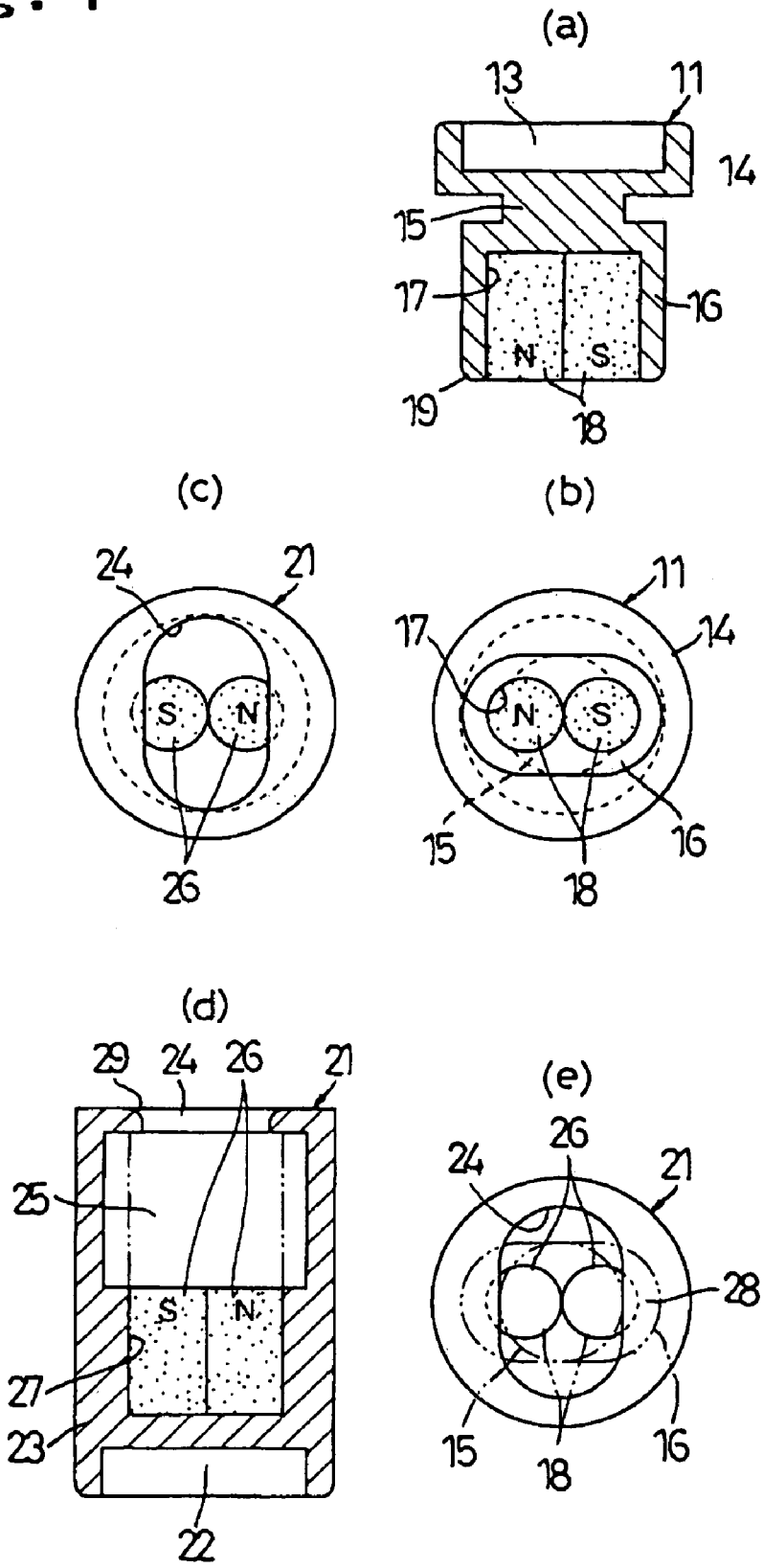
FIG. 1A is a cross sectional view showing a male part that constitutes an example 1 of a connector for accessories, etc., according to the invention.
FIG. 1B is a bottom view showing the male part.
FIG. 1C is a plan view showing a female part that constitutes the example.
FIG. 1D is a cross sectional view showing the female part.
FIG. 1E is a view illustrating a state of connection between the male part and the female part.

The invention will be described below in further detail on the basis of embodiments shown in the drawings. FIGS. 1A to 1E show a male part 11 and a female part 21 combined therewith in a connector 10 for accessories, etc., according to the invention.

Figure 5:
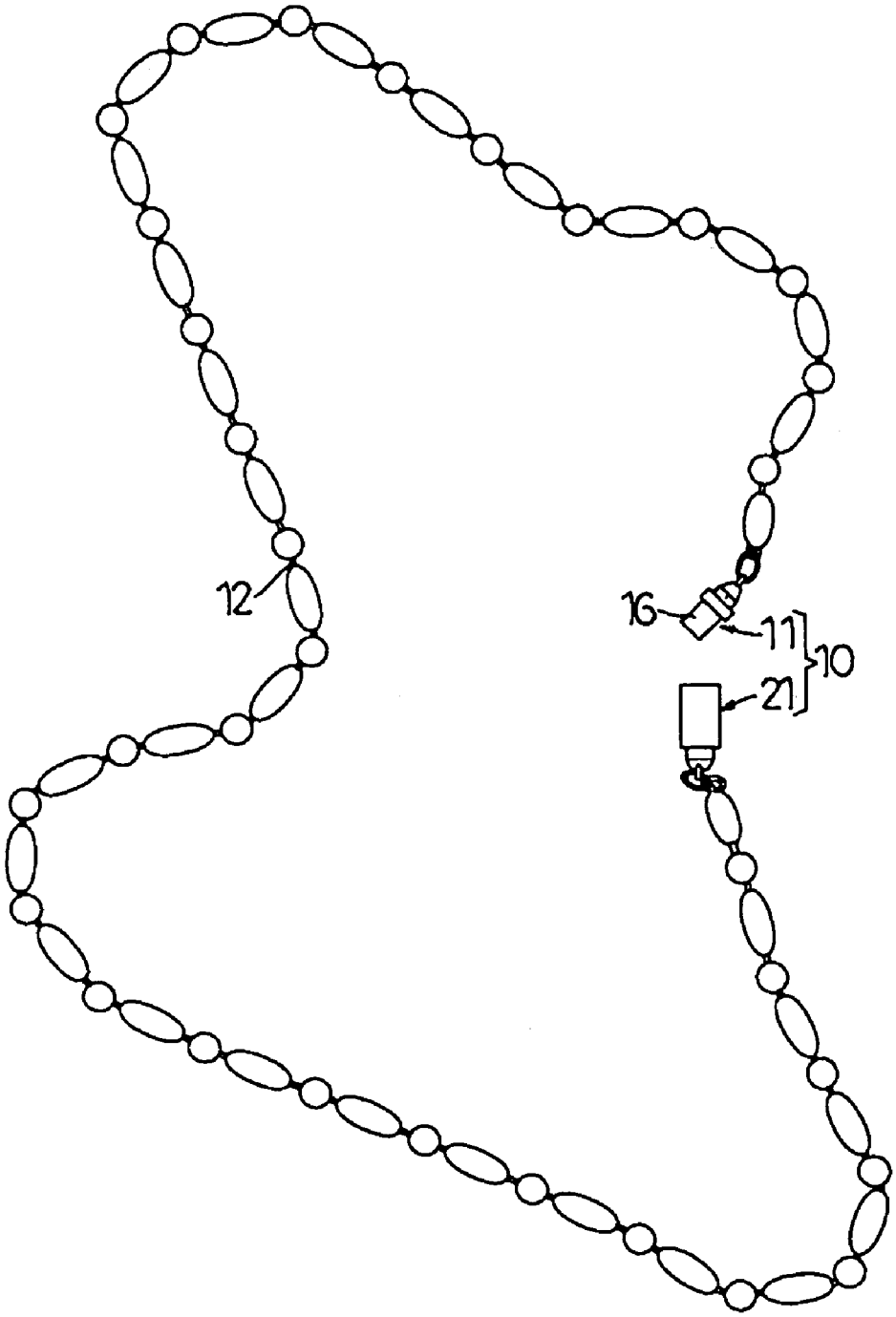
FIG. 5 is a general, perspective view showing a necklace being accessories, to which the connector of the invention is applied.

The male part 11 as shown in FIGS. 1A and 1B comprises a base 14 provided at one end thereof with a connection 13 for a linear member 12 shown in FIG. 5, a neck 15 provided on a surface opposed to the connection 13, and a head 16 provided outside the neck. The base 14 as illustrated is circular, the neck 15 is circular and smaller than the base 14, and the head 16 is elliptical to have a major axis, which is smaller than a diameter of the base and larger than a diameter of the neck, and a minor axis set to be the same as the diameter of the neck.

The head 16 is provided on an outer end surface thereof with a recess 17, into which magnets 18 are incorporated. Two magnets 18 are aligned in a longitudinal direction of the elliptical head 16 so that both N and S poles appear. A direction of the N and S poles is coincident with a direction of the major axis of an ellipse of the head 16.

The female part 21 as shown in FIGS. 1C and 1D comprises comprise a base 23 provided at one end thereof with a connection 22 for the linear member 12, and a fitting opening 24, which is disposed on a side opposed to the connection 22 and into which the head 16 of the male part 11 is fitted. A space communicated to outside only through the fitting opening 24 is provided inside the fitting opening 24 to serve as a cavity 25, in which the head 16 is received. Mating magnets 26 are provided at the bottom of the cavity 25 to be incorporated in a recess 27 in a manner to face the magnets 18 of the male part 11. A direction of the N and S poles of the mating magnets 26 forms 90 degrees relative to the direction of the major axis of the ellipse, which defines the fitting opening 24.

Accordingly, when the male part 11 is turned to a longitudinal state from a horizontal state shown in FIG. 1B to be fitted into the longitudinal fitting opening 24 of the female part 21 put in a state shown in FIG. 1C, and the male part 11 is kept apart in a state, in which the head 16 is in a position corresponding to the fitting opening 24, the head 16 of the male part 11 is automatically turned 90 degrees within the cavity 25 of the female part 21 by a magnetic attracting action between the both N and S poles of the male part 11 and the female part 21 (FIG. 1E). As a result, the head 16 of the male part 11 deviates 90 degrees from a position corresponding to the fitting opening 24 to come below a wall 28 of the fitting opening, so that the head 16 can no longer pass through the fitting opening 24. By further turning the head 16 90 degrees to enable the head to pass through the fitting opening 24 and pulling the head, disengagement can be simply effected. In addition, chamfers 19, 29 are provided on edges of the head 16 and the fitting opening 24 to facilitate engagement and disengagement.

Figure 2:
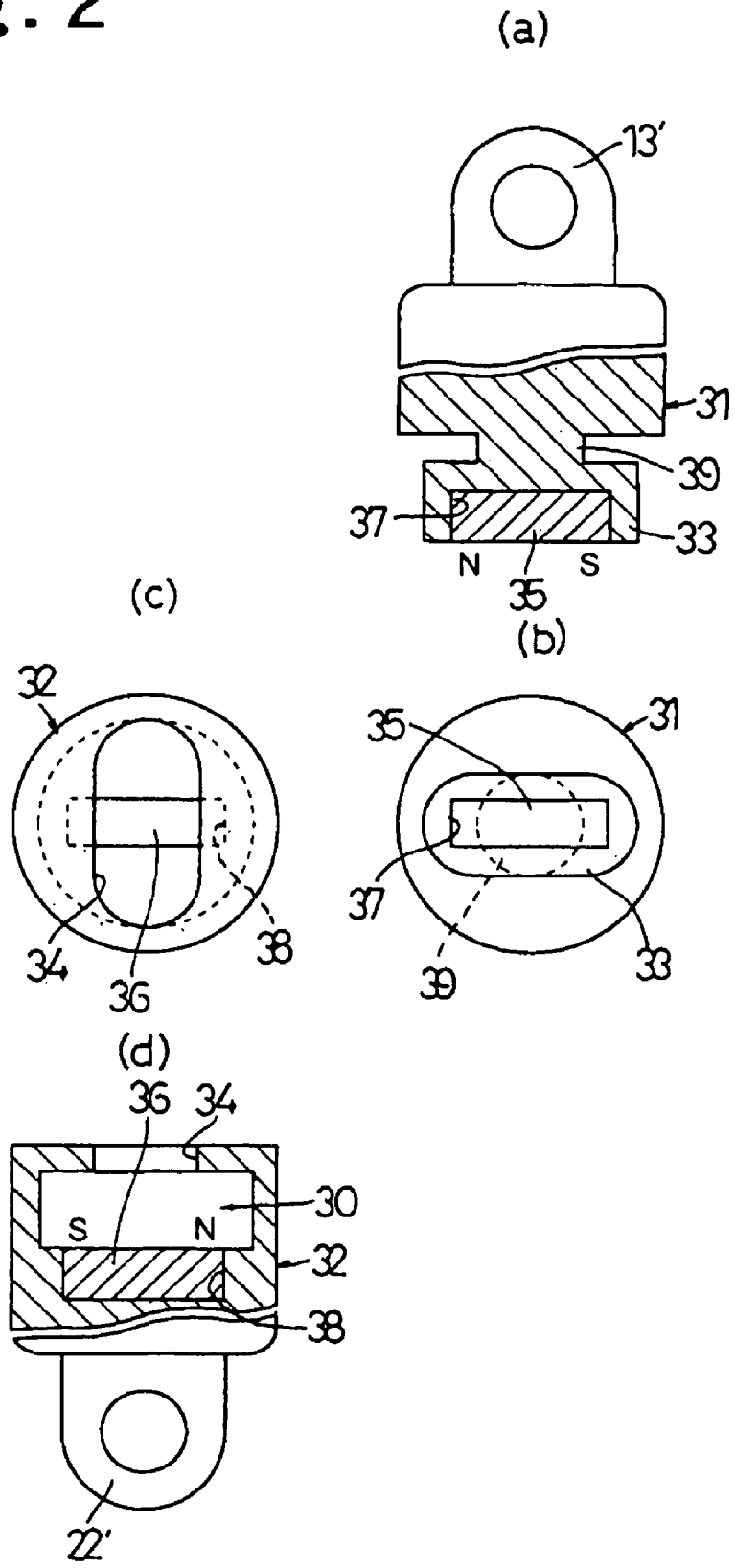
FIG. 2A is a partial, cross sectional view showing a male part that constitutes an example 2.
FIG. 2B is a bottom view showing the male part.
FIG. 2C is a plan view showing a female part that constitutes the example.
FIG. 2D is a partial, cross sectional view showing the female part.

In FIG. 2, a single magnet 35 having both N and S poles at both ends thereof is incorporated into a recess 37 provided on an outer end surface of a head 33 of a male part 31, and a single similar mating magnet 36 on a side of a female part 32 is incorporated into a recess 38. Positional relationships between the head 33 and the magnet 35 and between a fitting opening 34 and the mating magnet 36, and a head 39 being received in the fitting opening 34 are the same as those in a preceding example 1. With this example 2, the male part 31 and the female part 32 comprise connecting rings as connections 13', 22'.

A way of handling in the example 2 is the same as that in the example 1, and by setting the head 33 of the male part 31 to the fitting opening 34 of the female part 32 to fit the same thereinto and separating fingers, the head 33 is turned within a cavity 30 due to the magnetic attracting action and coupling is automatically achieved. In addition, at the time of disengagement, it suffices to move the head 33 looking for a position providing passage through the fitting opening 34 and to pull the head.

Figure 3:
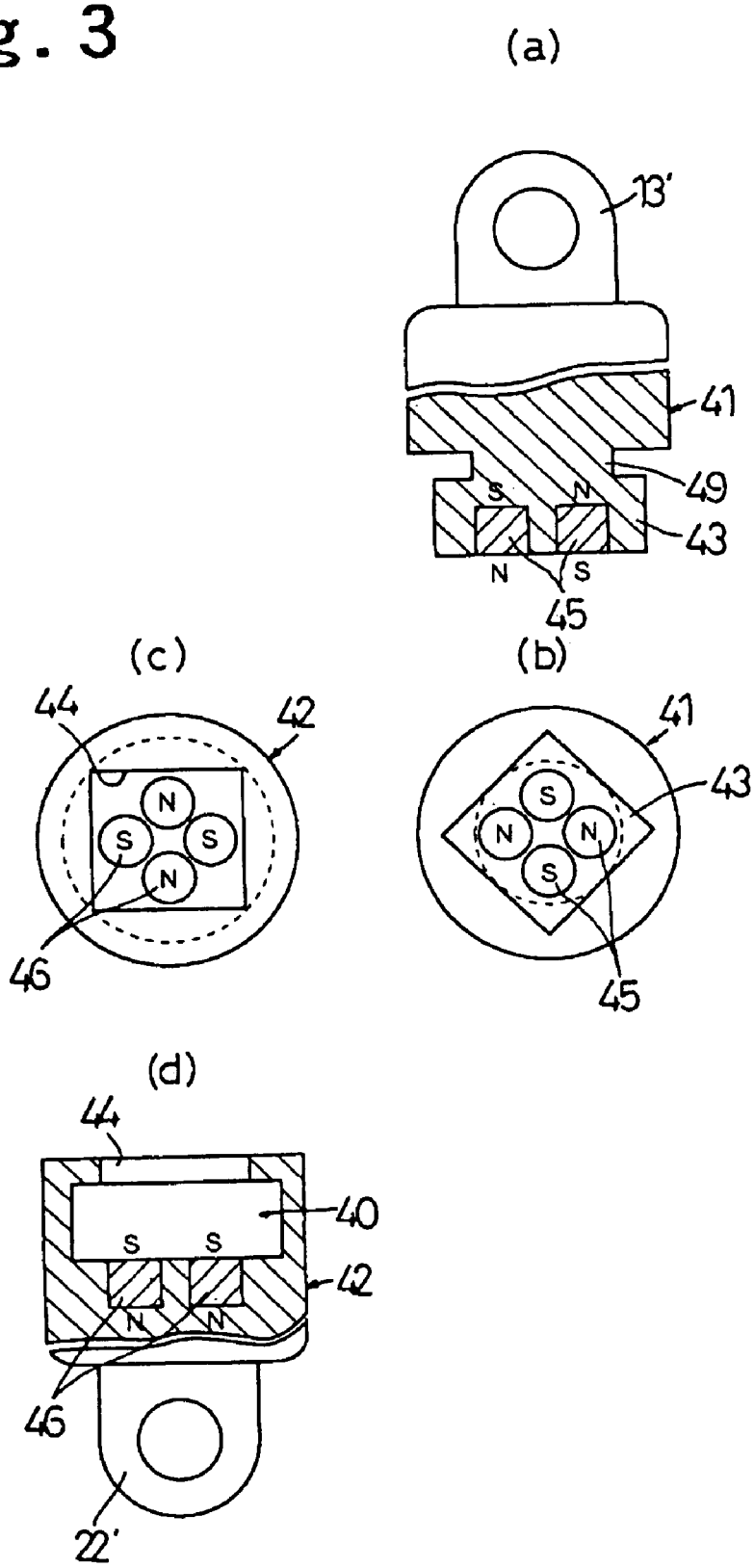
FIG. 3A is a partial, cross sectional view showing a male part that constitutes an example 3.
FIG. 3B is a bottom view showing the male part.
FIG. 3C is a plan view showing a female part that constitutes the example.
FIG. 3D is a partial, cross sectional view showing the female part.

FIG. 3 shows a head shaped to be quadrilateral other than elliptical, and a male part 41 and a female part 42 are the same in basic constitution as those in the two preceding examples. Since the quadrilateral shape corresponds to a square shape, 90 degrees cannot be made use of as an angle for engagement of a head 43 with a wall of a fitting opening, and 45 degrees is appropriate. Hereupon, four magnets 45 are used for the male part 41 and fitted every 90 degrees into the head, and mating magnets 46 are arranged on a side of the female part 42 to be offset 45 degrees relative to positions of the magnets in the male part 41 (see FIGS. 3B and 3C).

While a detailed explanation is omitted for an example 3 because an angle of relative turning effected between the male part 41 and the female part 42 is 45 degrees, both engagement and disengagement are carried out very smoothly. With the example 3, the magnets 45 are provided on the head 43 of the male part 41 and the mating magnets 46 are provided at the bottom of a cavity 40 of the female part 42 in the same manner as in the example 2 and the example 1.

Figure 4:
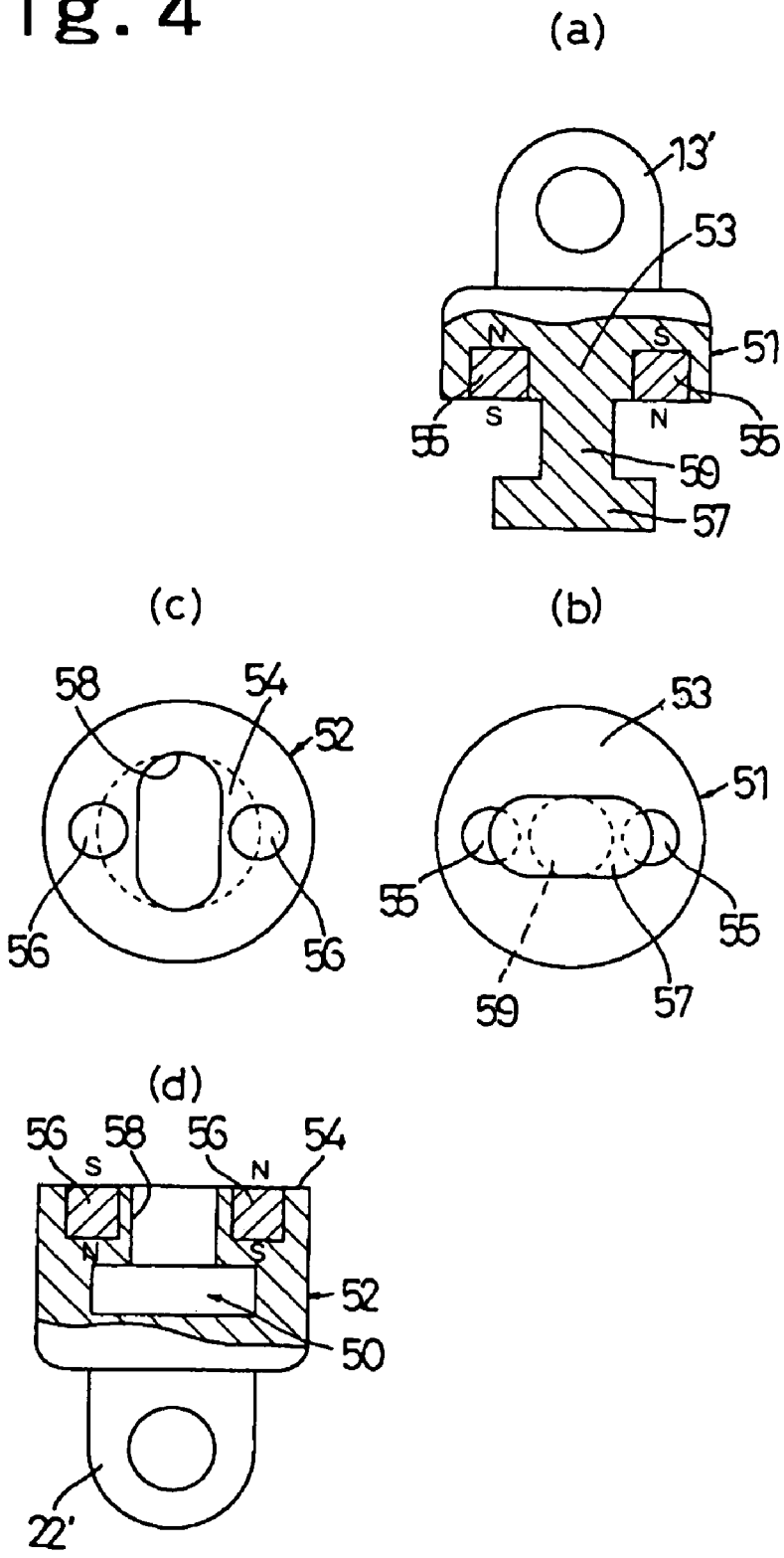
FIG. 4A is a partial, cross sectional view showing a male part that constitutes an example 4.
FIG. 4B is a bottom view showing the male part.
FIG. 4C is a plan view showing a female part that constitutes the example.
FIG. 4D is a partial, cross sectional view showing the female part.

In contrast, as shown in FIG. 4, magnets 55 are provided on a base 53 of a male part 51, and mating magnets 56 are provided on a front of a fitting wall 54 of a female part 52. The fitting and positioning relationship between a head 57 of the male part 51 and a fitting opening 58 of the female part 52 is the same as that in the examples 1 and 2. Therefore, by fitting the head 57 into a cavity 50 with an orientation of the head 57 made coincident with an orientation of the fitting opening 58, the head 57 is automatically turned due to the magnetic attracting action about a neck 59 positioned in the fitting opening 58 to be put in a state, in which the head 57 cannot get out of the fitting opening 58, and by looking for an orientation of the head 57 to set the same to an orientation of the fitting opening 58 and pulling the head, disengagement can be readily achieved.

Since the invention is constructed and functions as described above in such way that by fitting the head into the fitting opening, the male part and the female part are automatically put in a state, in which they cannot be separated from each other, due to the magnetic attracting action. Easy and sure connection is made possible even without conventionally conducting, behind the neck, operations of moving a small projection with nails, or engaging a projection of a stopper with a groove, so that the present invention provides an improved design that is easy to manufacture and operate because the construction is simple.

What is claimed is:

1. A connector for connecting both ends of an elongated linear ornamental accessory which is to be put to use in the form of an endless chain, the connector comprising a male part and a female part, which can be fitted into and separated from each other, and wherein magnets are provided in the male part and the female part in such a manner that when the male part is inserted into the female part through a fitting opening of the female part, magnetic attraction of the magnets causes a change in positional relationship between the male part and the female part so that the male part and the female part rotate relative to each other with the result that the male part cannot pass through the fitting opening of the female part without an external force.

2. The connector according to claim 1, wherein the male part comprises a head that passes through the fitting opening of the female part, and a neck being positioned in the fitting opening of the female part after fitting to enable relative turning of the male part, and the head is configured to be able to pass through the fitting opening and to assume that positional relationship, in which it cannot get out of the fitting opening without external force because the positional relationship is varied due to the magnetic attracting action after passage through the fitting opening.

3. The connector according to claim 1, wherein the female part comprises a cavity inwardly of the fitting opening, which permits a head of the male part to pass therethrough and allows rotation of the head of the male part.

* * * * *